US008784185B2

(12) United States Patent
Hardy et al.

(10) Patent No.: US 8,784,185 B2
(45) **Date of Patent: *Jul. 22, 2014**

(54) SYSTEM AND METHOD FOR CONDUCTING A GAME OF CHANCE

(71) Applicant: Scientific Games Holdings Limited, Ballymahon (IE)

(72) Inventors: Dow K. Hardy, Marlborough, MA (US); Francis J. Lichtenberger, Winchester, MA (US); Scott N. Weller, Windham, NH (US); Michael C. Lightman, Easton, CT (US); John E. Taylor, Jr., Vero Beach, FL (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/847,089

(22) Filed: Mar. 19, 2013

(65) Prior Publication Data

US 2013/0225283 A1 Aug. 29, 2013

Related U.S. Application Data

(63) Continuation of application No. 12/846,946, filed on Jul. 30, 2010, now Pat. No. 8,398,479, which is a continuation-in-part of application No. 12/829,628, filed on Jul. 2, 2010, now Pat. No. 8,597,109.

(60) Provisional application No. 61/222,647, filed on Jul. 2, 2009, provisional application No. 61/230,165, filed on Jul. 31, 2009.

(51) Int. Cl.
*A63F 9/24* (2006.01)

(52) U.S. Cl.
USPC ..... 463/20; 463/16; 463/29

(58) Field of Classification Search
CPC ... G07F 17/32; G07F 17/3239; G07F 17/329; G06F 21/64; G06Q 10/00
USPC ..... 463/17–25, 42
See application file for complete search history.

(56) References Cited

U.S. PATENT DOCUMENTS 6,656,050 B2 12/2003 Busch et al.
6,663,105 B1 12/2003 Sullivan et al.

(Continued)

FOREIGN PATENT DOCUMENTS

WO WO 2009/146366 12/2009

OTHER PUBLICATIONS

Search Report and Written Opinion for PCT/US2010/043891 dated Oct. 25, 2010, 9 pages.

(Continued)

*Primary Examiner* — Masud Ahmed
(74) *Attorney, Agent, or Firm* — Dority & Manning, P.A.

(57) ABSTRACT

Provided are systems and methods configured to retain game state information during the course of game play of multiple individual games to deliver a gaming experience in addition to the game play and/or any outcome associated with the individual games and/or game sessions. Player interest can be enhanced through the requirement that multiple games be played to get to a final outcome of the game experience. Each ticket/entry can represent one step along the way (or some other ratio) of the game experience. Combining online experiences with a progression through the gaming experience with stored state information across sessions allows a game management system to track and manage the player until the game experience is complete and can include, for example, requiring a predetermined number of plays. Further the game management system can permit dynamically establishing criteria for players during any game experience.

20 Claims, 5 Drawing Sheets

(56) References Cited

U.S. PATENT DOCUMENTS

| | | | | |
|---|---|---|---|---|
| 7,008,317 | B2 | 3/2006 | Cote et al. | |
| 7,285,045 | B2 | 10/2007 | Schneier et al. | |
| 7,303,468 | B2 | 12/2007 | Schneier et al. | |
| 7,699,706 | B2 | 4/2010 | Walker et al. | |
| 7,914,370 | B2 | 3/2011 | Weller | |
| 2004/0219982 | A1 | 11/2004 | Khoo et al. | |
| 2006/0178187 | A1 | 8/2006 | Walker et al. | |
| 2007/0026924 | A1 | 2/2007 | Taylor | |
| 2007/0149267 | A1 | 6/2007 | Ross et al. | |
| 2007/0173322 | A1 | 7/2007 | Swamy et al. | |
| 2007/0265055 | A1* | 11/2007 | Berman | 463/16 |
| 2008/0009344 | A1* | 1/2008 | Graham et al. | 463/25 |
| 2008/0032762 | A1 | 2/2008 | Kane et al. | |
| 2008/0045299 | A1* | 2/2008 | Bennett et al. | 463/17 |
| 2008/0064492 | A1 | 3/2008 | Oosthoek | |
| 2008/0146346 | A1 | 6/2008 | Hardy et al. | |
| 2009/0023490 | A1* | 1/2009 | Moshal et al. | 463/17 |
| 2009/0093300 | A1* | 4/2009 | Lutnick et al. | 463/26 |
| 2009/0176578 | A1 | 7/2009 | Herrmann et al. | |
| 2009/0191962 | A1 | 7/2009 | Hardy et al. | |
| 2010/0029376 | A1 | 2/2010 | Hardy | |
| 2011/0081958 | A1 | 4/2011 | Hardy et al. | |

OTHER PUBLICATIONS

PCT Search Report, Dec. 27, 2011.

* cited by examiner

SYSTEM AND METHOD FOR CONDUCTING A GAME OF CHANCE

RELATED APPLICATIONS

The present application is a Continuation Application of U.S. application Ser. No. 12/846,946, filed Jul. 30, 2010, which is a Continuation-in-Part of U.S. application Ser. No. 12/829,628, filed Jul. 2, 2010, which claims priority to U.S. Provisional Application Ser. No. 61/222,647, filed Jul. 2, 2009, which applications are incorporated herein by reference in their entirety. The present application also claims priority to U.S. application Ser. No. 12/846,946, filed Jul. 30, 2010 that claims priority to U.S. Provisional Application Ser. No. 61/230,165, filed Jul. 31, 2009, which applications are incorporated herein by reference in their entirety.

FIELD OF INVENTION

The field of the invention relates generally to electronic games of chance and methods and systems for conducting game play.

BACKGROUND

It can be appreciated that gambling establishments (e.g., casino, lottery or other lawful physical or online gambling establishments) have a desire to keep their players engaged and interested in their brand. Player loyalty clubs, "member's only" clubs, or similar programs are a common method used by gambling establishments to attempt to achieve this goal. Bonus play games and "second chance" games are another method that may be used by some gambling establishments to increase participation and brand interaction. These second chance games typically attempt to reward a player's losing efforts by making the player eligible to participate in a second chance drawing, contest, or event.

While player clubs can be a valuable tool for gambling establishments, the clubs typically are not very engaging and they do not provide an adequate incentive for players to regularly interact with the player club or the gambling establishment, especially regarding interactions beyond the actual act of gambling. Similarly, second chance games typically are not very interactive or engaging and they often do not generate a level of excitement or interest necessary to promote prolonged interaction with the gambling establishment or its brand. Even bonus play and predetermined games, can be constrained by gaming regulation, in order to achieve the broadest possible market, certain elements of gambling styled games may not be provided—these constraints can reduce entertainment value for a particular player.

SUMMARY

It is realized that improved methods are required to provide players with multiple incentives and multiple opportunities to interact with the gambling establishment or its brand to help gambling establishments increase customer loyalty and participation. These methods can also be used to gather important information about their players. One should appreciate that information gathering and player loyalty/participation aspects need not be constrained to gambling establishments and may include almost any establishment intending to market a product or service.

Through the increased interaction, increased loyalty, and the gathered information, the gambling establishment, for example, can advance many goals such as providing an improved player experience, further increasing player interaction and loyalty, increasing play, or motivating the player to take some action desired by the gambling establishment. It is realized that achieving increased player interest in the gaming experience itself can be used as an effective tool to increase play and/or motivate the player to take some action.

According to one aspect, game state information may be retained during the course of game play, and a particular game state can be used to drive a gaming experience throughout the play of multiple reveal, bonus play, money play, and/or second chance games (to illustrate a few game examples). In one example, bonus play awards may be provided to a particular player in response to the player qualifying, receiving an invitation, and performing a desired action. The bonus play award entitles the player to 2 spins in a bonus game. The number of spins played is retained for the player, preserving a new state element to the bonus game. In this example, a bonus experience is provided over the course of 5 consecutive games (10 total spins) with each successive game adding elements to the bonus game.

According to another aspect, player interest can be enhanced through the requirement that multiple games be played to get to the final outcome. Each ticket/entry represents one spin or step along the way (or some other ratio). Combining online experiences with the progression through the gaming experience with stored state information across sessions allows the game management system to track and manage the player until the game experience is complete. The gaming experience can require a predetermined number of plays. In one alternative the number of plays is variable depending on skill of the player, but over a plurality of players and a plurality of games, it can be determined that on average, x number of tickets would be required to complete a game. In one embodiment, information may be provided to players with respect to average performance, average number of tickets required to progress through a particular game and game experience. This information can be provided with a selection of a plurality of games and gaming experiences, providing a player with choices as to how to best participate in their own gaming experience. One should appreciate that allowing a player to select an experience that is perceived to be within the player's capability increases the likelihood that the player will complete the experience. Moreover players who believe that they can outperform an average metric, can earn a sense of achievement in doing so. Both choices and the situations in which they are made (play achievable game experiences vs. risk being unable to complete an experience) provide information on the particular player—that can be retained and used to establish player models.

According to one aspect, a method for providing a gaming experience over a plurality of individual game sessions is provided. The method comprises the acts of providing for a player to obtain entries to the plurality of individual game sessions, providing the gaming experience, wherein the gaming experience is rendered over at least two of the plurality of individual game sessions, and wherein the act of providing the gaming experience includes acts of associating an identifier with at least one of the player, the gaming experience, any entries, and the at least two of the plurality of individual game sessions, storing state information for the at least one of the player, the gaming experience, any entries, and the at least the portion of the plurality of individual game sessions, establishing state associated criteria, and permitting the player to play at least one individual game session in a graphical user interface of a computer system, wherein the play of the individual game session displays at least a portion of the gaming experience.

According to one embodiment, the method further comprises acts of permitting a game operator to establish state associated criteria, and requiring the state criteria be met in order to progress in the gaming experience. According to one embodiment, the method further comprises an act of providing a primary game, wherein the act of providing for the player to obtain entries to the plurality of individual game sessions includes accepting played entries into the primary game as entries into the individual game sessions. According to one embodiment, the primary game comprises a lottery game. According to one embodiment, the method further comprises an act of printing a unique identifier on the surface of a lottery entry. According to one embodiment, the individual game sessions include a reveal based game. According to one embodiment, the individual game sessions include a bonus play game. According to one embodiment, the individual game sessions include a second chance game. According to one embodiment, the individual game sessions include a predetermined game. According to one embodiment, the method further comprises an act of generating a script configured to control at least one aspect of the gaming experience.

According to one embodiment, the method further comprises an act of executing the script in response to state information. According to one embodiment, the act of generating a script configured to control at least one aspect of the gaming experience occurs dynamically in response to state information. According to one embodiment, the individual game sessions include at least one of a reveal based game, a second chance game, an online game, an offline game, and a game comprising an online and offline portion. According to one embodiment, the state information includes at least one of a start time, an end time, an enrolment time, a closing time, a minimum number of entries, a maximum number of entry, a sweepstake game status, a current number of entries, and a remaining number of entries to complete the gaming experience. According to one embodiment, the method further comprises an act of permitting the game operator to change established state associated criteria.

According to another aspect, a computer-readable medium having computer-readable signals stored thereon that define instructions that, as a result of being executed by a computer, instruct the computer to perform a method for providing a gaming experience over a plurality of individual game sessions is provided. The method comprising the acts of providing for a player to obtain entries to the plurality of individual game sessions, providing the gaming experience, wherein the gaming experience is rendered over at least two of the plurality of individual game sessions, and wherein the act of providing the gaming experience includes acts of associating an identifier with at least one of the player, the gaming experience, any entries, and the at least two of the plurality of individual game sessions, storing state information for the at least one of the player, the gaming experience, any entries, and the at least the portion of the plurality of individual game sessions, establishing state associated criteria, and permitting the player to play at least one individual game session in a graphical user interface of a computer system, wherein the play of the individual game session displays at least a portion of the gaming experience.

According to one embodiment, the method further comprises acts of permitting a game operator to establish state associated criteria, and requiring the state criteria be met in order to progress in the gaming experience. According to one embodiment, the method further comprises an act of providing a primary game, wherein the act of providing for the player to obtain entries to the plurality of individual game sessions includes accepting played entries into the primary game as entries into the individual game sessions. According to one embodiment, the primary game comprises a lottery game. According to one embodiment, the method further comprises an act of printing a unique identifier on the surface of a lottery entry. According to one embodiment, the individual game sessions include a reveal based game. According to one embodiment, the individual game sessions include a bonus play game. According to one embodiment, the individual game sessions include a second chance game. According to one embodiment, the individual game sessions include a predetermined game. According to one embodiment, the method further comprises an act of generating a script configured to control at least one aspect of the gaming experience.

According to one embodiment, the method further comprises an act of executing the script in response to state information. According to one embodiment, the act of generating a script configured to control at least one aspect of the gaming experience occurs dynamically in response to state information. According to one embodiment, the individual game sessions include at least one of a reveal based game, a second chance game, an online game, an offline game, and a game comprising an online and offline portion. According to one embodiment, the state information includes at least one of a start time, an end time, an enrolment time, a closing time, a minimum number of entries, a maximum number of entry, a sweepstake game status, a current number of entries, and a remaining number of entries to complete the gaming experience. According to one embodiment, the method further comprises an act of permitting the game operator to change established state associated criteria.

According to another aspect a system for providing a game experience over a plurality of individual game sessions is provided. The system comprises an entry component configured to accept entries into a plurality of individual game sessions, a game play component configured to generate the gaming experience, wherein the gaming experience is provided over at least two of the plurality of individual game sessions, an association component configured to associate an identifier with at least one of the player, the gaming experience, an entry, and the at least two of the plurality of individual game sessions, a state component configured to store state information for the at least one of the player, the gaming experience, an entry, and the at least two of the plurality of individual game sessions, a management component configured to store state associated criteria in memory, and wherein the game play component is further configured to permit the player to play at least one individual game session in a graphical user interface of a computer system, wherein the player of the individual game session displays at least a portion of the gaming experience.

According to one embodiment, the system is further configured to permit a game operator to establish state associated criteria, and require the state criteria be met in order to progress in the gaming experience. According to one embodiment, the system is further configured to provide a primary game, wherein the entry component is further configured to accept played entries into the primary game as entries into the individual game sessions. According to one embodiment, the primary game comprises a lottery game. According to one embodiment, the system is further configured to recognize a unique identifier on the surface of a lottery entry. According to one embodiment, the individual game sessions include a reveal based game. According to one embodiment, the individual game sessions include a bonus play game. According to one embodiment, the individual game sessions include a second chance game.

According to one embodiment, the individual game sessions include a predetermined game. According to one embodiment, the system is further configured to permit a game operator to generate a script configured to control at least one aspect of the gaming experience. According to one embodiment, the system is further configured to execute the script in response to state information. According to one embodiment, the system is further configured control at least one aspect of the gaming experience dynamically in response to state information. According to one embodiment, the individual game sessions include at least one of a reveal based game, a second chance game, an online game, an offline game, and a game comprising an online and offline portion. According to one embodiment, the state information includes at least one of a start time, an end time, an enrolment time, a closing time, a minimum number of entries, a maximum number of entry, a sweepstake game status, a current number of entries, and a remaining number of entries to complete the gaming experience. According to one embodiment, the system is further configured to permit the game operator to change established state associated criteria.

According to one aspect a method for conducting a game of chance is provided. The method comprises the acts of associating a primary game having a primary win opportunity with a second game, providing the second game having a second chance win opportunity, requiring that a player of the second chance game be uniquely identified, providing a second chance game interface, and permitting the player to play a second game through the second chance game interface, wherein the second chance game reveals an outcome of the second chance win opportunity. According to one embodiment, the primary game includes a portion of the primary game played offline and a partial game result obtained offline, and a portion of the primary game played online and a remaining portion of a game result obtained online. According to another embodiment, the portion of the primary game that is played offline including one or more areas of a game ticket capable of being revealed offline, the portion of the game result obtained online including one or more outcomes corresponding to one or more areas of the game ticket that cannot be revealed offline. According to another embodiment, the act of requiring the player be uniquely identified includes an act of requiring that the player enter into a membership club. According to another embodiment, the method further comprises an act of associating a state identifier with the second game. According to another embodiment, the method further comprises associating game state information with the unique identifier. According to another embodiment, the method further comprises providing a unified game experience across a plurality of games. According to another embodiment the act of providing a unified game experience includes executing a game script configured to control at least one game element based at least in part on stored state information.

BRIEF DESCRIPTION OF THE DRAWINGS

Various aspects of at least one embodiment are discussed herein with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures, detailed description, and/or claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. In the figures:

DETAILED DESCRIPTION

Figure 1:
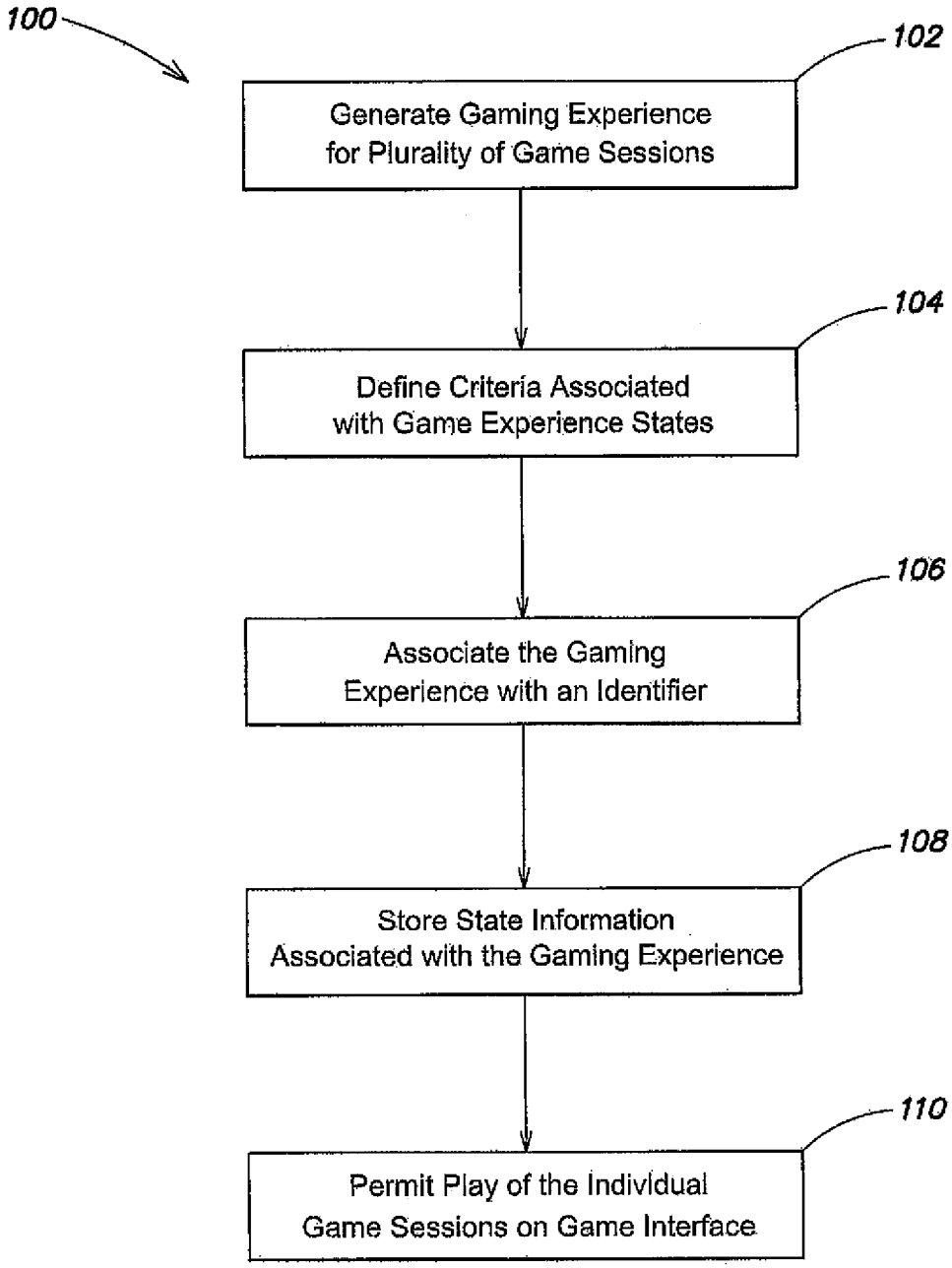
FIG. 1 is an example process for providing a game experience over a plurality of individual game sessions, according to aspects of the invention.

It is realized that gaming players are competitive in many different respects, not only with winnings but with status with respect to other players and that incorporating status information into a gaming experience (a bonus game experience, a second chance game experience, a reveal game experience) provides opportunities for the player to compete and develop greater affinity for the gaming experience.

Some aspects of specific game methodologies and implementations that can be employed in conjunction with the present disclosure are discussed in co-pending applications U.S. application Ser. No. 11/001,775, by Kane et al, entitled "METHOD AND APPARATUS FOR CONDUCTING A GAME OF CHANCE," filed on Nov. 30, 2004 incorporated herein by reference in its entirety, and in co-pending U.S. application Ser. No. 11/789,693 entitled "METHOD AND APPARATUS FOR CONDUCTING A GAME OF CHANCE," to Herrmann et al. filed on Apr. 25, 2007, and to U.S. application Ser. No. 11/780,882 entitled "METHOD AND APPARATUS FOR PROVIDING PLAYER INCENTIVES," by Hardy et al. filed on Jul. 20, 2007, which applications are incorporated herein by reference in their entirety. Additionally, U.S. application Ser. No. 12/829,628, by Herrmann et al, entitled "SYSTEM AND METHOD FOR INCREASING PLAYER PARTICIPATION," filed on Jul. 2, 2010, which claims priority to U.S. Provisional Application Ser. No. 61/222,647 "SYSTEM AND METHOD FOR INCREASING PLAYER PARTICIPATION," by Herrmann et al, filed on Jul. 2, 2009, discuss some aspects and methodologies of second chance games and engaging players which applications are incorporated herein by reference in their entirety.

In one embodiment, new elements can include game play elements, increased bonus award outcomes, increased multipliers, and/or increased values of award, as non-limiting examples. The completion of the game play sequence through a plurality of game instances can itself entitle a player to an award. Awards can be in almost any form. In some examples, awards can take the form of additional bonus play entries, additional entries into second chance games, among other examples.

A player interface can be provided to a player having earned bonus player entries, money play entries, sweepstakes entries, lottery entries etc. In one embodiment the interface provides information on the game a player wishes to enter. In particular, a graphical user interface displays information about available games including information about how many entries a particular game experience requires. For some game experiences various requirements can be identified to a player through the graphical user interface. One example games requires participation in a plurality of games in a plurality of locations. In another example, game requirements include gaming activity in a specific location and are coupled with game requirements for online gaming activity, and may further include affiliated locations that do not provide for gaming, for example an affiliated restaurant. Game state information can be tracked with player participation, to record not only conformance with stated game requirements, but also to provide an interesting overall gaming experience throughout multiple game sessions. Various elements of the gaming experience can be locked until aspects of the requirements are met.

A further example includes a player who participates in casino gambling at a physical location. The player earns multiple bonus awards though play of table games, and begins a gaming experience through participation in the bonus game awards at the same casino. However, the state variable associated with the gaming experience can require online activity as well as real world activity. Until the player participates online, the gaming experience provided through bonus play may be restricted to a specific implementation. Notification can be presented to the player regarding a present game state based at least in part on the state variable. Notification may also include information on how to achieve the next and/or a different game state. In one example, new states may be achieved simply by logging into an online bonus game system. The online system can be operatively connected to a game management system, to provide information on a real-time, near real-time, and/or batch reporting basis. Similarly gaming activity taking place at casino location, gambling location, can be tracked by in place systems that are operatively connected to a gaming management system, reporting on state information on a real-time, near real-time, and/or batch basis.

Example Embodiments

In one embodiment, a gaming experience is provided over the course of a predetermined number of separate game sessions. According to some embodiments, the gaming experience is in addition to any outcome and/or results that naturally result from participation in individual games. The gaming experience augments the player's experience, providing, for example, thematic progression through a course of games, display of common content, and can even provide for additional awards, increased multipliers and the like.

In one embodiment, the state or status that a player attains and retains between play does not directly influence the outcome of the game. The status is a separate indicator of play experience that players can then compete for or measure themselves against other players. It is realized that gaming players are competitive in many different respects, not only with winnings but also with status with respect to other players. Accumulating status, in terms of badges or rank or comparative scores, is as important to some players as monetary awards. It can be appreciated that status that is accumulated over time and game plays is more compelling than status from a single play.

In another example, it takes a predetermined number of tickets to complete on-line play of a gaming experience. In one example game, entries/tickets (whether physical, electronic, and/or virtual) into a game provide two spins. With two spins per entry it would take 5 entries into a game that required 10 spins to complete the gaming experience. In another example, games state can be affected by actions performed by the player. An online entry may have an associated minimum to achieve another game state, and even a plurality of minimums to progress through various states, however, the progression by participating only online can be limited. In one embodiment, certain states can only be achieved through both online participation and participation at a particular physical location, for example a gambling location. Once participation has been perform through the physical location and online location, all states, some states or progression to another state can be made available. Various game states can be linked to multiple entry vehicles (online, offline, specific location, specific location at specific time, among others) and a plurality of desired player activity.

In one embodiment, to complete the play of a game, multiple tickets are required. Each ticket can represent an individual entry to a game session. In one example, the play of the game may be spread out over many turns, such as a game of Bingo where 40 balls are drawn. One ticket might entitle a player to receive Bingo cards and see the first 10 balls drawn. Each subsequent ticket can entitle a player to see an additional 10 balls drawn. In one embodiment, 4 tickets would be required to complete the game play of a single game of Bingo.

In one alternative of a Bingo game, each subset of 10 balls drawn are only provided by different types of tickets. This requires the player to not only purchase (or receive) 4 tickets to complete play, but a player would be required to be 4 different types of tickets. In a lottery example, this would equate to 4 differently branded scratch tickets. For example, tickets provided by different game operators could qualify as ticket of different type. In another example, ticket types can be associated with a specific denomination (e.g. $1 scratch ticket, $2, $5, etc). Thus a player can be required to play multiple tickets with varying characteristics in order to progress.

In another example, the gaming experience can include a thematic progression. Each redeemed entry advances a player through some overarching thematic progression. Various implementation of thematic progression can be provided.

One example includes levels-based progressions. In one embodiment, a player is required to play in level 1 of the gaming experience until the player accumulates enough points, badges and/or play elements to get to next level. Achieving the next level can also be triggered off of a number of redeemed/played entries/tickets.

In another embodiment including thematic progression, themes are divided by levels of play and are character-based in a single-player mode. In this example, the level of game may be an immersive environment or episode, or it may be a different maze or game skill level (levels become harder to complete as you progress). Transition from one level to the next may be based on accumulating points or badges that are simply based on the number (or type) of tickets that the player has purchased. Alternatively, transition from one level to the next may be based on achievements (skill or chance or predetermined) in the current level. As an example, video games commonly have a character (the Boss) at the end of a level that must be defeated prior to moving to the next level. As another alternative, both the number of tickets and level achievements may be required to advance to the next level.

In another embodiment, compelling content in the thematic progression is only made available over time. In this example, game play is spread over time because the new level is only available over time. As an example, the player must wait until the content is available prior to playing his ticket; otherwise the game is played within the context of the previously played content. In another example, the actual purchase of the ticket is required to be spread out over time in order to make the current content available. For example, tickets purchased at a certain time are only applicable to the story line content at that time. Once new story line content has been made available, then all subsequent ticket purchases are for the new content. It can be appreciated that if the content is compelling enough that players will develop anticipation for the next piece of content in the thematic progression. Other players may become aware of the buzz around the next piece of content and purchase tickets because of their interest in being "willing to take a look". Alternatively, different ticket types may be required to access the different story line content.

Another example includes a gaming experience reflective of a serial story. In one example, a continuation of the story line happens serially over time, so that a player is required to space out play (or purchases) of tickets over time to gain access. In another embodiment, timing elements are introduced to gate access to a next portion of the gaming experience. For example, a player can have a timing requirement in addition to other progression criteria. A player can be required to play in a portion of the gaming experience, regardless of the number of redemptions, gaming plays, and/or game purchases until a time threshold is met, and only upon expiration of the predetermined time can a player move into the next level of the gaming experience. Time elements can be used in conjunction with other requirements. For example, there may be a minimum number of plays required to achieve the second level in a gaming experience, however, the second level can also be restricted by time, so even if the player has met the minimum gaming entry/purchase requirement, the time elapsed may not be sufficient to permit access to the second level of the gaming experience.

Another embodiment includes massively multiplayer online role playing games. In particular, experience progression (experience referring to both character experience and the actual game experience provided to the player (the world, realm, adventure, etc.)) can be stored as a state variable associated with a game session and/or game sessions. The state variable can also be associated with a unique identifier provided with a primary game, a player account, and/or a player's subscription information. Various activities can signal to the system that a particular requirement has been achieved, and in response to a determination that state requirements have been met, enhancements to the gaming experience can result. In one example, different worlds become accessible in response to achieving a specific state. In one alternative, different tools/weapons become accessible. In some embodiments, new weapons, new tools, and/or new adventures are provided as awards in the individual game sessions that make up the overall gaming experience. Additionally, the conclusion of the game experience can trigger an award of any kind.

FIG. 1 illustrates and example process 100 for providing an overall gaming experience across a plurality of individual game sessions. The overall gaming experience can be generated at 102. Game states can be established within and/or associated with the overall gaming experience. The overall gaming experience can require a progression through the any series of game states. Each game state can be configured with its own criteria in order to progress from one state to the next. At 104, the game operator can define criteria for progression through a game state. State criteria can include a certain number of individual game plays, an accumulation of a threshold number of points, a specific game player, as some examples. Some game states can be configured to permit player skill to influence progression for one state to the next. In some examples player skill does not affect progression through game states.

The overall game experience is associated with a unique identifier at 106. As a player participates in an overall gaming experience state information can be stored using the unique identifier at 108. The state information can include completed games, completed game states, active games, active game states, game play information, game experience, game level, game points, etc. At 110, a gaming interface is provided to individual players over a communication network, for example the Internet. A player can access the game interface using a host computer system executing a convention browser program. The game interface permits players to select games in which they wish to participate. In one example, a player purchases entries into individual games. Although in some embodiments entries can be awarded, associated with other games, provided as a second chance, provided as a bonus game and the player's participation in any game can be tracked and a progression of game state providing over multiple games plays.

In some examples, an overall gaming experience can be configured to require a predetermined number of entries. In other examples, the gaming experience can require a variable number of entries. A gaming interface can provide information on the number of entries required. The interface can identify a predetermined entry requirement and further can provide information on an average number of entries required for games with variable requirements.

The game states with the overall gaming experience can be configured to provide a story line with each game state representing a step in the overarching story. In another embodiment of thematic progression, the themes are divided by levels of play within a multi-player environment. One skilled in the art can appreciate the compelling nature of Massively Multiplayer Online Role Playing Games (MMORPG). In this example, the player is able to play the game of skill or chance within an MMORPG environment and keep state between ticket plays. Additional tickets allow continued play in the form of: more time within the game; access to new levels within the game; access to different weapons/tools/features within the game; access to new environments within the game; or any other variation in the MMORPG play that creates real or perceived value. In another embodiment of the multi-player environment, players are able to join teams or syndicates that enhance the game play further.

One should appreciate that a gaming experience can be provided over a plurality of games, and the vehicle by which entries into the plurality of games can take almost any form. In particular, play of primary games yield outcomes for participating players. The plays of the primary games can be used as entries into the individual game sessions that make up the over-all game experience itself. For example, a scratch ticket player may purchase 20 $1 scratch tickets, in a second chance game example, the scratch tickets can be used as entries into a second chance game. Holding 20 $1 (typically losing tickets) provides 20 entries into the second chance game. The play of the 20 entries can now provide a unique and entertaining gaming experience through the course of the entries into the second chance game. One should appreciate that any type of game can be used for the primary game, and one should also appreciate that play of a primary game may not be necessary as entries into the individual game sessions that make up any gaming experience can be awarded to players directly as an incentive and/or marketing campaign. In some embodiments, player can purchase entries directly. In some examples, ticketed entries can be configured to permit progression through a game in conjunction with awarded entries. Both types of entries can be required to complete the game play.

As primary games can vary, certain embodiments encourage participation in a wide variety of primary games. Other embodiments encourage player participation in multiple engagement paths between a game operator and the player. In one example, scratch tickets represent a physical interaction with a player and game state variables can reflect that a player interacts with a gaming establishment physically, and thus a game script and/or a game requirement can be imposed to achieve another game state. In one example, a player gets different content/play opportunities based on playing a broad selection of tickets. If a player only plays scratch tickets, the player gets one experience. If the player only plays on-line tickets, you get a different experience. For a player that does both, another experience can be provided. Similar embodiments exist in the scratch tickets space, where a player needs to have played four different $5 tickets in order to get the advanced experience.

Other embodiments, includes providing a player with badges/rank or some other non-monetary benefit for playing multiple tickets (quantity or diversity of tickets). Badges/rank may or may not change the experience or win amounts. In one example, the gaming experience can be provided in conjunction with the individual game sessions being entered, but the overall gaming experience is provided for entertainment purposes and does not impact any value of an outcome presented to a player.

State criteria for achieving different states in gaming experiences can include minimum number of entries into the gaming experience (and/or the underlying individual game sessions). Some game experiences can be unending game experiences. In particular, entries into individual game sessions can be stored, and in conjunction with each entry a virtual entity (role playing character, racing vehicle, virtual athlete) gains ability, stature feature. The increase in power, experience, level and/or features can continue without limit so long as the player wishes to continue the experience.

Other state criteria can require different types of gaming play, different types of primary games. Variations can be made in the types of games and types of game play interface required to achieve different states and the timing involved in participating in the types of games and types of game play interface can also play a role.

In another embodiment, the award of the game may not be something of value in the physical world (cash, loyalty points, sweepstakes entries, etc.), but rather is something of value in the on line game world. As an example, the player can win badges or advancement of rank as part of a game of chance. Alternatively, the player can win virtual goods or services (tools, weapons, potions, etc.) or virtual currency to be used in the on line game as part of a game of chance. In another example, the game of chance may award early advancement into the next level of play of the on line game.

Figure 4:
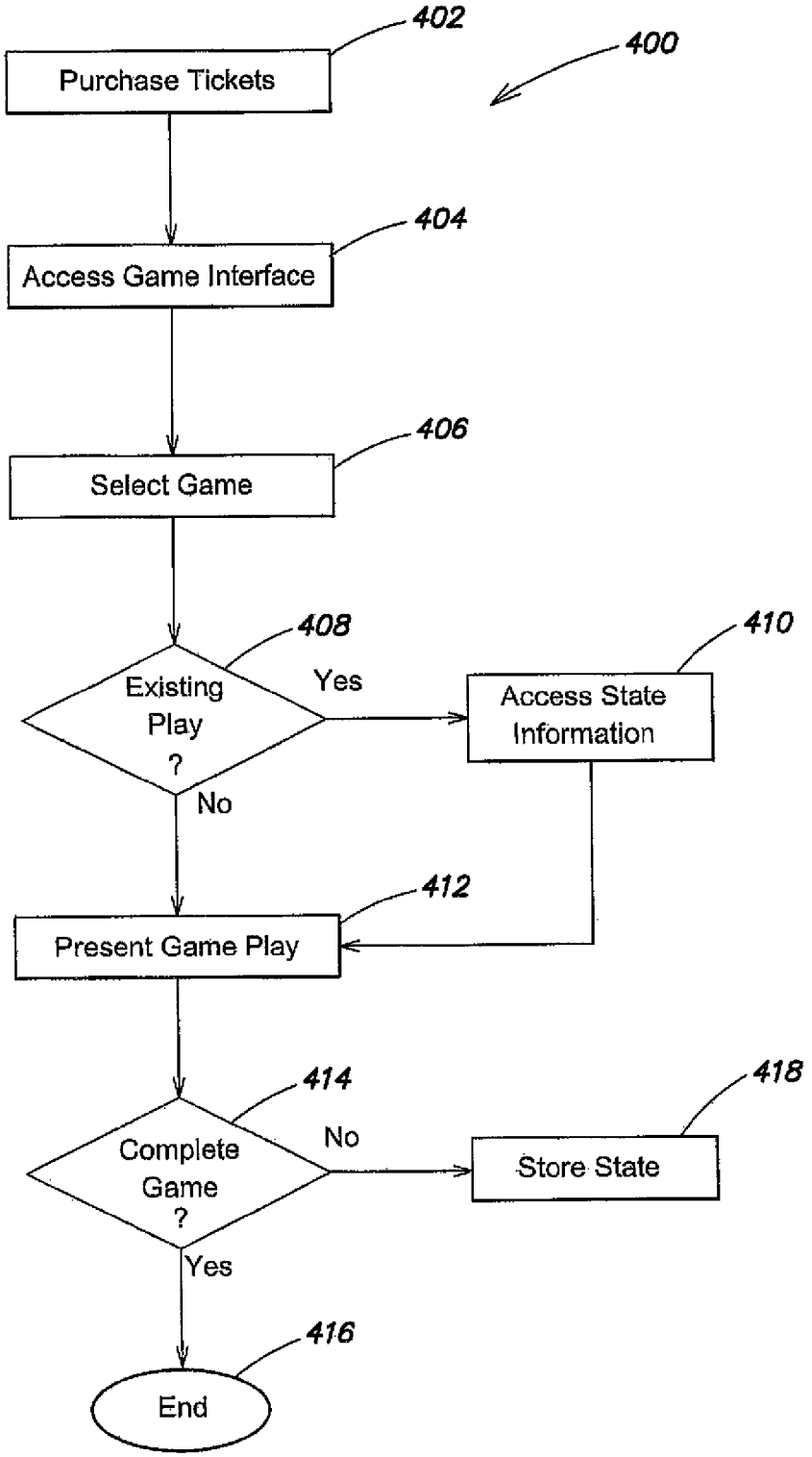
FIG. 4 is an example process for providing a game experience over a plurality of individual game sessions, according to aspects of the invention.

In one example process 400, shown in FIG. 4, a player purchases lottery tickets at 402. The lottery ticket is associated with an extended play features that permits the player to use each ticket as a "credit" towards the play of at least one of the individual game sessions that makes up the gaming experience. In some embodiments only tickets that do not provide winning outcomes can be used as credits towards the play of at least one of the individual game sessions that make up the gaming experience. In some other embodiments, any ticket can be used as credit for entry. A player may access extended play over a communication network, for example the Internet at 404. In one setting a player accesses a webpage from a home computer system, the webpage provides access to extended play features and/or games. In at least some implementations a player may select an extended play game, oftentimes player preference for a type of game can control such decisions. Once the game has been selected, 406, the gaming system determines at 408 if any play of the selected game has occurred. If yes 408 Yes, the game returns the player to the event, time, and/or place where the player left off in a previous game session at 410. For an extended play game that provides spin style games, a player can enter the serial number of the ticket into an interface displayed on their home computer, in response the game computer system awards a predetermined number of spins into the spin styled game. At the end of the predetermined number a spins a player can be presented with the option to provide additional ticket serial numbers, if a player selects to end game play, the present state is retained and is reloaded upon the return of the player to the game play. At 412, the game play for the selected game is presented. If state information exists 408 Yes, the state information is determined 410 and the game play presented at 412 reflects any previous state of the game play. If no prior play exists 408 No, the game play is presented to the player at 412. Once the game play associated with an entry is complete, process 400, can determined whether the overall game experience is complete at 414. If not 414 No, the current state for the game can be stored for later access. If the game experience is complete 414 Yes, process 400 can be configured to end at 416. In some alternatives, process 400 can include steps for determining if a player has additional entries and continuing play rather than storing current state and/or ending play.

In at least some embodiments, players can be presented choice of extended play game in a gaming interface, but once a game experience has been selected and remains in progress, the gaming computer system can be configured to present any gaming experiences that are in progress first and/or at a higher priority than any other extended play games. In at least some embodiments, for players who have only one current game experience in progress, the system will default to the current game experience and provide an option to exit to select a new game.

One example game implementation includes the following activities:

Buy lottery ticket and it's a non-winner

Go home and login to the VIP section of the lottery's website

Select featured extended play game.

One should appreciate that almost any game can be used for the extended play game, one requirement can include multiple plays in order to complete the gaming experience Game opens to the place where player left off during last game sessions Enter the serial # on the ticket which awards a reel spin in the extended play game Repeat for as many tickets the player has or until end of game When a player runs out of tickets, the game stores any state so that a player can return and resume play at a later time.

Game, Parameter and Event Scripting Examples

According to another aspect, scripted events and/or scripted game play can be used to generate greater player interest in gaming experience. Scripting second chance game interactions, including scripting the selection of game and game criteria itself based on particular event provides opportunity for creating player incentives to get players to perform desired actions. Additionally, the scripting of game play itself can increase player interest in the overall gaming experience, increasing the likelihood that a player participates in desired activities and/or increasing the likelihood the player participates in second chance games. Although second chance games have been discussed in particular, one should appreciate that scripting events, game parameters, and/or game play can be applied to other games and other types of games, for example reveal style games, bonus play games, etc.

According to one embodiment, in scripted play, the play experience is defined by a predefined/prewritten script. Typically a script includes an ordered set of commands. One implementation can include a script protocol defining commands:

Issue next 'command'

Interpret/process 'command'

Gather user input

Interpret/process user input

Determine next 'command' in script (if applicable, based on user input or other available data states)

In other embodiments, scripts can be used to define commands that alter the play experience by setting local data or states in the software of a game play computer system, or in the computer system that renders the game play of the selected game. In one example, the script includes an operation for establishing a number of credits. Number_of_credits=10, although one should appreciate that almost any value can be used in place of 10. Operations can define a 'command' in the script. In other embodiments, scripts alter the play experience by initiating a set of interface elements, animations, interactive components. In one example conditional logic can be used to invoke certain games with predefined parameters:

```
if bonus_round_qualified and total_win > 1000
then play SuperBonusRound
else play NormalBonusRound
```

In some examples providing for scripted game play, an auditing process collects and gathers all inputs and actions and what was displayed on the end device. Each command of the script can link to one, many or a combination of other scripts. This allows for additional paths based on the other data variables. For instance, user input can be one data point that allows a player to experience an alternate path #1 vs. alternate path #2.

Typically the script is stored in memory, on disk or in a database. Although various embodiment include networked servers from which scripts can be downloaded for execution as needed, and in some examples scripts can be dynamically generated to yield specific outcomes and/or results. Conventionally the script can be interpreted and executed by one, many or a combination of processors. The script can be stored on a server and requested by a client machine/application.

A script can exist across multiple sources points. For instance, the first part of the script can be stored in database A and the second in database B with all scripts linked by a common unique identifier, such as a name or ID. Status information can be employed to gate access to scripts that generate various elements of a gaming experience, and as each gate is traversed by completing various requirements, different elements of an overall script can be implemented.

Scripts

Scripts should be flexible and designed to achieve flexibility. For games that include badges/rank or some other non-monetary benefit of playing multiple tickets (quantity or diversity of tickets) an example script could indicate

```
if unique_ticket_types_played_within_30_days >= 10
then set add_player_badge = 'legionaire'
add 1000 to player_points
```

In some games, badges/rank may or may not change the experience or win amounts.

Other scripts can include the gaming experience generating different content/play opportunities based on playing a minimum number of tickets.

```
minumum_number_of_tickets = 5;
if number_of_tickets_played >= minimum_number_of_tickets
then
    number_of_credits = 20
else
    number_of_credits = 10
```

Various embodiments according to the present invention may be implemented on one or more computer systems. These computer systems can be, for example, general-purpose computers such as those based on Intel Atom, Core, or PENTIUM-type processor, IBM PowerPC, AMD Athlon or Opteron, Sun UltraSPARC, or any other type of processor. It should be appreciated that one or more of any type computer system can be used to providing a gaming experience over a plurality of game sessions, validating entry into a gaming experience, associating the game experience with an identifier, managing state associated criteria, storing state associated information, configuring scripts, managing scripts, hosting and/or serving scripts to game play systems, etc. Further, the system may be located on a single computer or may be distributed among a plurality of computers attached by a communications network.

A general-purpose computer system according to one embodiment of the invention is configured to perform any of the described operations and/or algorithms, including but not limited to providing for management scripts, providing gaming interfaces, accessing state information, maintaining and/or managing state information for a plurality of players, managing state information for a plurality of games, among other options. It should be appreciated, however, that the system may perform other operations and/or algorithms, including operations for registering players, providing access to online and/or offline games, awarding entries, associating unique identifiers to tickets and/or other forms of entry, rendering a game selection interface, providing state information associated with timing limitations and/or other limitations, establishing levels associated with state and/or individual game entries, etc. The operations and/or algorithms described herein can also be encoded as software executing on hardware that define a processing component, that can further define portions of a specially configured general purpose computer, reside on an individual specially configured general purpose computer, and/or reside on multiple specially configured general purpose computers.

Figure 2:
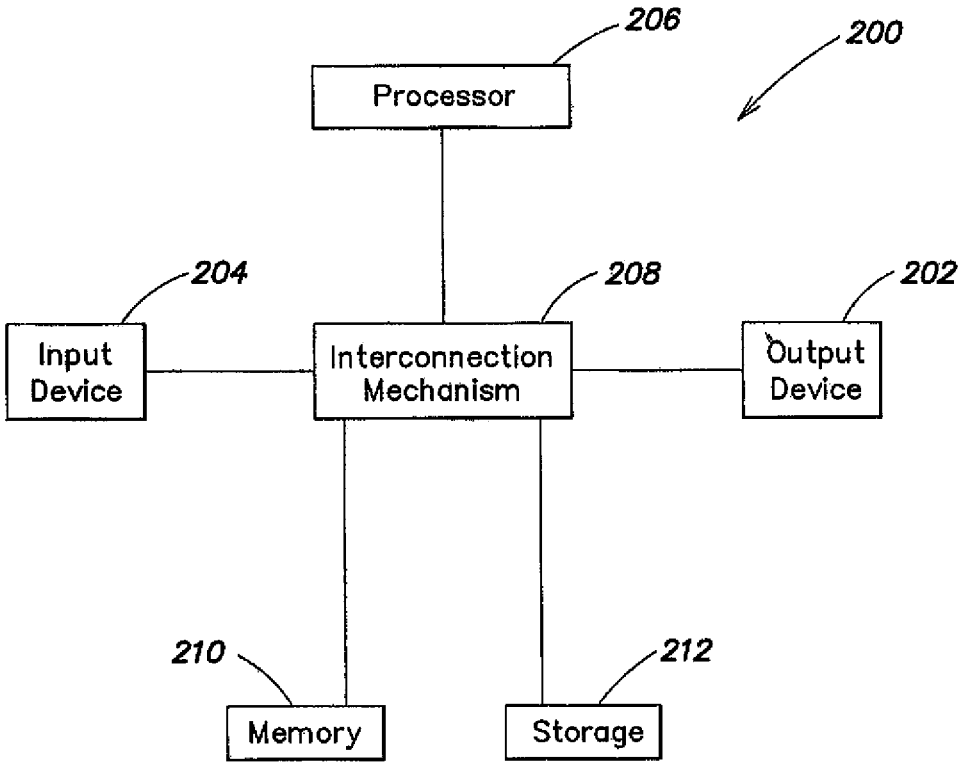
FIG. 2 is a block diagram of an example system for providing a game experience over a plurality of individual game sessions, according to aspects of the invention.

FIG. 2 shows a block diagram of a general-purpose computer system 200 in which various aspects of the present invention can be practiced. For example, various aspects of the invention can be implemented as specialized software executing in one or more computer systems including general-purpose computer systems 504, 506, and 508 communicating over network 502 shown in FIG. 5. Computer system 200 may include a processor 206 connected to one or more memory devices 210, such as a disk drive, memory, or other device for storing data. Memory 210 is typically used for storing programs and data during operation of the computer system 200. Components of computer system 200 can be coupled by an interconnection mechanism 208, which may include one or more busses (e.g., between components that are integrated within a same machine) and/or a network (e.g., between components that reside on separate discrete machines). The interconnection mechanism enables communications (e.g., data, instructions) to be exchanged between system components of system 200.

Computer system 200 may also include one or more input/output (I/O) devices 202-204, for example, a keyboard, mouse, trackball, microphone, touch screen, a printing device, display screen, speaker, etc. Storage 212, typically includes a computer readable and writeable nonvolatile recording medium in which instructions are stored that define a program to be executed by the processor or information stored on or in the medium to be processed by the program.

Figure 3:
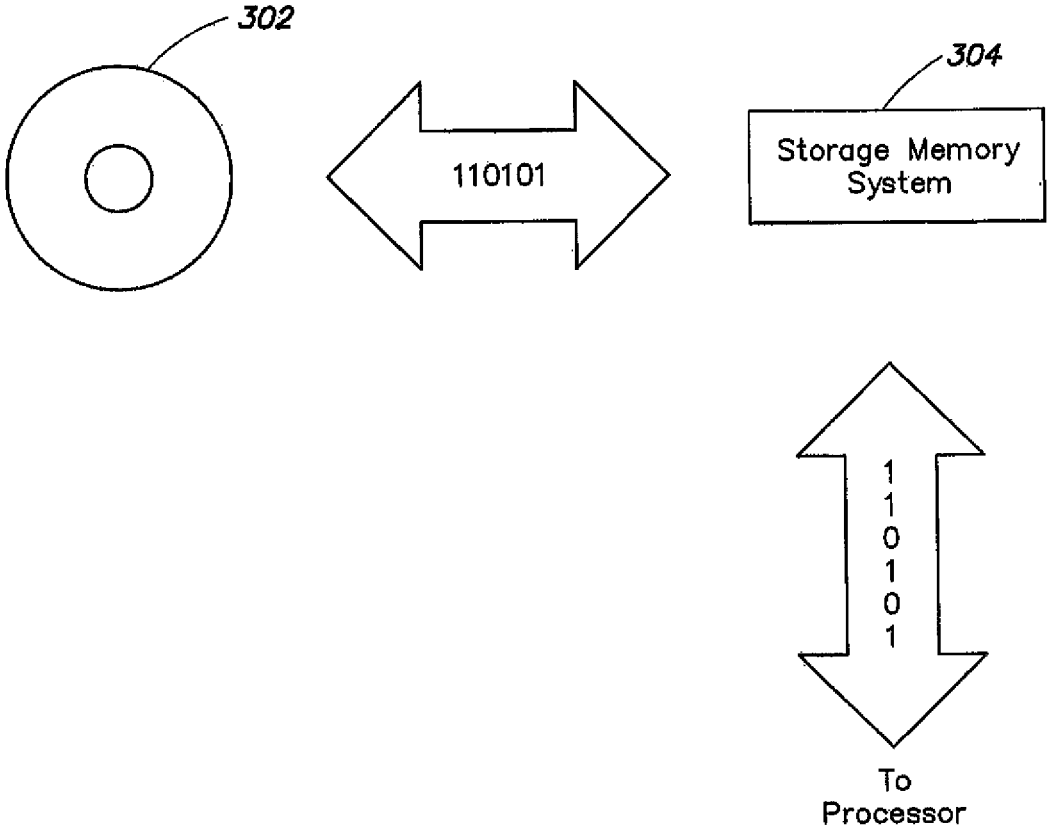
FIG. 3 is a block diagram of an example system for providing a game experience over a plurality of individual game sessions, according to aspects of the invention.

The medium may, for example, be a disk 302 or flash memory as shown in FIG. 3. Typically, in operation, the processor causes data to be read from the nonvolatile recording medium into another memory 304 that allows for faster access to the information by the processor than does the medium. This memory is typically a volatile, random access memory such as a dynamic random access memory (DRAM) or static memory (SRAM). In one example, the computer-readable medium is a non-transient storage medium.

Referring again to FIG. 2, the memory can be located in storage 212 as shown, or in memory system 210. The processor 206 generally manipulates the data within the memory 210, and then copies the data to the medium associated with storage 212 after processing is completed. A variety of mechanisms are known for managing data movement between the medium and integrated circuit memory element and the invention is not limited thereto. The invention is not limited to a particular memory system or storage system.

The computer system may include specially-programmed, special-purpose hardware, for example, an application-specific integrated circuit (ASIC). Aspects of the invention can be implemented in software, hardware or firmware, or any combination thereof. Although computer system 200 is shown by way of example as one type of computer system upon which various aspects of the invention can be practiced, it should be appreciated that aspects of the invention are not limited to being implemented on the computer system as shown in FIG. 2. Various aspects of the invention can be practiced on one or more computers having a different architectures or components than that shown in FIG. 2.

It should also be appreciated that the invention is not limited to executing on any particular system or group of systems. Also, it should be appreciated that the invention is not limited to any particular distributed architecture, network, or communication protocol.

Various embodiments of the invention can be programmed using an object-oriented programming language, such as Java, C++, Ada, or C# (C-Sharp). Other object-oriented programming languages may also be used. Alternatively, functional, scripting, and/or logical programming languages can be used. Various aspects of the invention can be implemented in a non-programmed environment (e.g., documents created in HTML, XML or other format that, when viewed in a window of a browser program, render aspects of a graphical-user interface (GUI) or perform other functions). The system libraries of the programming languages are incorporated herein by reference. Various aspects of the invention can be implemented as programmed or non-programmed elements, or any combination thereof.

Various aspects of this invention can be implemented by one or more systems similar to system 200. For instance, the system can be a distributed system (e.g., client server, multi-tier system) comprising multiple general-purpose computer systems. In one example, the system includes software processes executing on a system associated with providing a gaming experience over a plurality of games and/or game sessions, which can include operations such as awarding entries into individual games, managing criteria for game progression, establishing game state criteria, storing information on individual player progression within an individual game, within an game session, within a game state, and within a game experience, as examples. The systems may permit the end users to access and manage their game experience online, provide information on active game experiences, available game experiences, etc. The systems can permit game operators to define game experiences, establish requirements for completing a game experience, establish requirements for progression through the game experience, define game states within the game experience, redefine any criteria during game experiences, create game scripts, store game scripts, and manage game scripts, for example.

There can be other computer systems that perform functions such as receiving and associating game experience information with a unique identifier, permitting individualized game experiences on an individual player basis, the systems can also manage any limitation and/or criteria associated with the game experience, including for example a time limitation for a given state with the game experience, a participation requirement, a requirement for a number of entries, and other associated criteria. These systems can also be configured to operate individual games independent of the game experience provided across multiple game plays. These systems can be distributed among a communication system such as the Internet. One such distributed network, as discussed below with respect to FIG. 5, can be used to implement various aspects of the invention.

Figure 5:
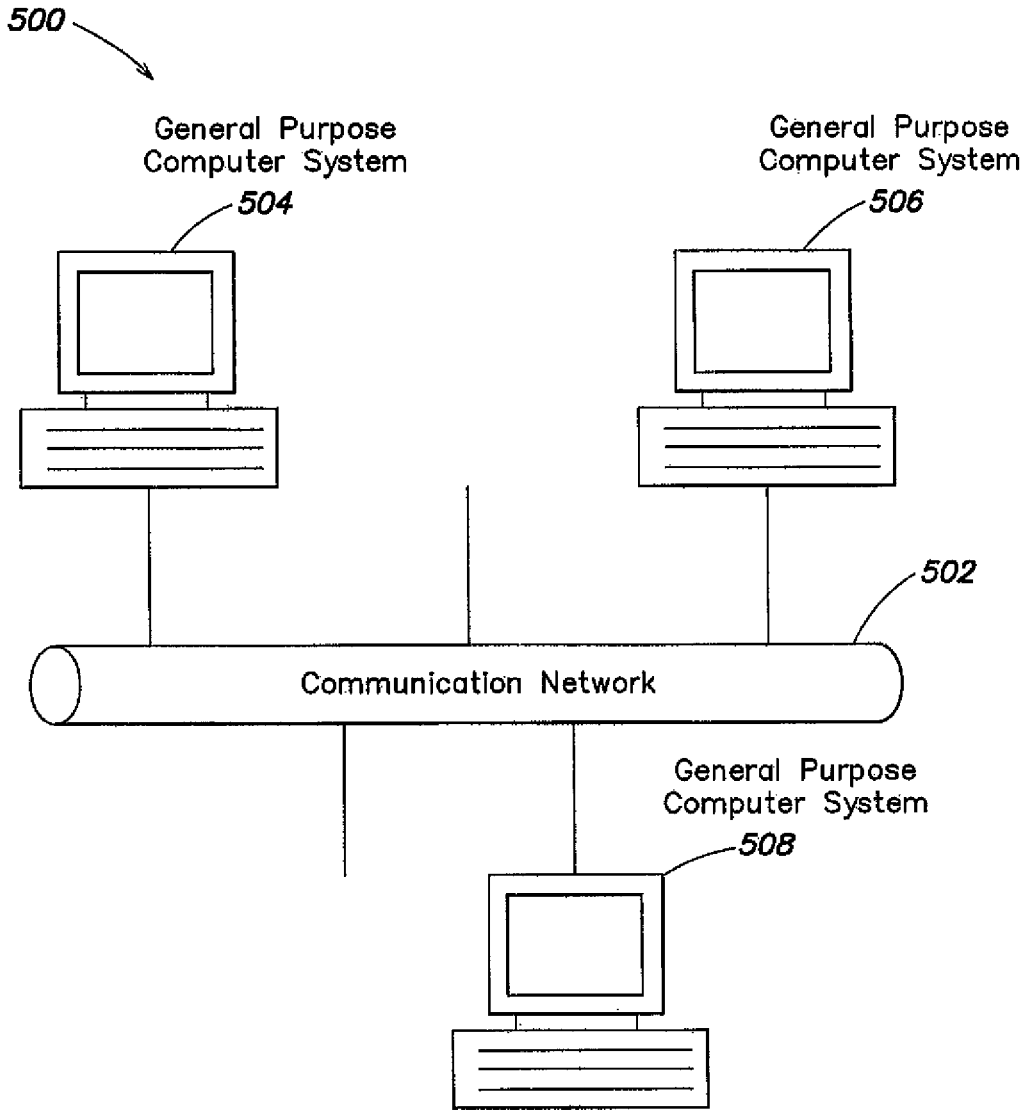
FIG. 5 is a block diagram of an example system for providing a game experience over a plurality of individual game sessions, according to aspects of the invention.

FIG. 5 shows an architecture diagram of an example distributed system 500 suitable for implementing various aspects of the invention. It should be appreciated that FIG. 5 is used for illustration purposes only, and that other architectures can be used to facilitate one or more aspects of the invention. System 500 may include one or more general-purpose computer systems distributed among a network 502 such as, for example, the Internet. Such systems may cooperate to perform functions related to conducting a game experience over a plurality of individual games and/or game sessions. In an example of one such system, one or more users operate one or more client computer systems 504, 506, and 508 through which the user/player can access a game interface, play the individual games, participate in the game experience, select individual games, and select a game experience, as examples. It should be understood that the one or more client computer systems 504, 506, and 508 can also be used to access, for example, player registration systems, player award systems, player entry systems, game operator management systems, etc. In one example, users interface with the system via an Internet-based interface.

In another example, a system 504 includes a browser program such as the Microsoft Internet Explorer application program, Mozilla's FireFox, or Google's Chrome browser through which one or more websites can be accessed. Further, there can be one or more application programs that are executed on system 504 that perform functions associated with conducting sweepstakes. For example, system 504 may include one or more local databases for storing, caching and/ or retrieving game state information associated with a game experience, individual game information, entry information, etc.

Network 502 may also include, as part of the system for providing a game experience over a plurality of individual games and/or game sessions, one or more server systems, which can be implemented on general-purpose computers that cooperate to perform various functions including providing a game interface, accessing individual games, maintaining script information, executing individual games and/or game sessions, permitting user selection of a game experience, selection of games and/or game sessions, accepting entry information, validating entry into a gaming experience, associating the game experience with an identifier, managing state associated criteria, storing state associated information, among other functions. System 500 may execute any number of software programs or processes and the invention is not limited to any particular type or number of processes. Such processes can perform the various workflows and operations associated with a system for providing a game experience over a plurality of games and/or game sessions, validating entry into a gaming experience, associating the game experience with an identifier, managing state associated criteria, storing state associated information, etc.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Further, for the one or more means-plus-function limitations recited in the following claims, the means are not intended to be limited to the means disclosed herein for performing the recited function, but are intended to cover in scope any means, known now or later developed, for performing the recited function.

As used herein, whether in the written description or the claims, the terms "comprising", "including", "containing", "characterized by" and the like are to be understood to be open-ended, i.e., to mean including but not limited to. Only the transitional phrases "consisting of" and "consisting essentially of", respectively, shall be closed or semi-closed transitional phrases, as set forth, with respect to claims, in the United States Patent Office Manual of Patent Examining Procedures (Eighth Edition 2nd Revision, May 2004), Section 2111.03.

Use of ordinal terms such as "first", "second", "third", "a", "b" "c" etc., in the claims to modify or otherwise identify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method for providing a gaming experience over a plurality of individual game sessions, the method comprising:

allowing a player at least one entry into the plurality of individual game sessions;

rendering the gaming experience over at least two of the plurality of individual game sessions such that the player must meet criteria for each individual game session and progress through the plurality of individual game sessions in order to complete the gaming experience, wherein rendering the gaming experience comprises:

associating an identifier with the player;

storing progress information regarding the gaming experience of the player; and permitting the player to play at least one individual game session in a graphical user interface of a computer system.

2. The method of claim 1, further comprising acts of:

permitting a game operator to establish state associated criteria; and requiring the state criteria be met in order to progress in the gaming experience.

3. The method of claim 1, further comprising an act of providing a primary game, wherein the act of providing for the player to obtain entries to the plurality of individual game sessions includes accepting played entries into the primary game as entries into the individual game sessions.

4. The method of claim 3, wherein the primary game comprises a lottery game.

5. The method of claim 4, further comprising an act of printing a unique identifier on the surface of a lottery entry.

6. The method of claim 3, wherein the individual game sessions include a reveal based game.

7. The method of claim 3, wherein the individual game sessions include a bonus play game.

8. The method of claim 3, wherein the individual game sessions include a second chance game.

9. The method of claim 3, wherein the individual game sessions include a predetermined game.

10. The method of claim 1, further comprising an act of generating a script configured to control at least one aspect of the gaming experience.

11. The method of claim 10, further comprising an act of executing the script in response to state information.

12. The method of claim 10, wherein the act of generating a script configured to control at least one aspect of the gaming experience occurs dynamically in response to state information.

13. The method of claim 1, wherein the individual game sessions include at least one of a reveal based game, a second chance game, an online game, an offline game, or a game comprising an online and offline portion.

14. The method of claim 11, wherein the state information includes at least one of a start time, an end time, an enrolment time, a closing time, a minimum number of entries, a maximum number of entry, a sweepstake game status, a current number of entries, or a remaining number of entries to complete the gaming experience.

15. The method of claim 2, further comprising an act of permitting the game operator to change established state associated criteria.

16. A non-transitory computer-readable medium having computer-readable signals stored thereon that define instructions that, as a result of being executed by a computer, instruct the computer to perform a method for providing a gaming experience over a plurality of individual game sessions, the method comprising:

allowing a player at least one entry into the plurality of individual game sessions;

rendering the gaming experience over at least two of the plurality of individual game sessions, such that the player must satisfy entry criteria for each individual game session and progress through the plurality of individual game sessions in order to complete the gaming experience and wherein the act of providing the gaming experience includes acts of:

associating an identifier with the player;

storing progress information regarding the gaming experience of the player; and permitting the player to play at least one individual game session in a graphical user interface of a computer system, wherein the play of the individual game session displays at least a portion of the gaming experience.

17. A system for providing a game experience over a plurality of individual game sessions, the system comprising:

an entry component configured to accept entries into a plurality of individual game sessions;

a game play component configured to:

generate the gaming experience, wherein the gaming experience is provided over at least two of the plurality of individual game sessions such that the player must satisfy entry criteria for each individual game session and progress through the plurality of individual game sessions in order to complete the gaming experience;

an association component configured to associate an identifier with the player;

a progress component configured to store progress information regarding the gaming experience of the player; and wherein the game play component is further configured to permit the player to play at least one individual game session in a graphical user interface of a computer system, wherein the player of the individual game session displays at least a portion of the gaming experience.

18. The system of claim 17, wherein the entry component is further configured to accept entries already played as part of a primary game as entries into the individual game sessions.

19. The system of claim 18, wherein the entry component is configured to accept a unique identifier associated with a lottery game play as an entry into an individual game session.

20. The method of claim 1, further comprising a script component configured to control at least one aspect of the gaming experience.

* * * * *